US010134371B2

(12) United States Patent
Higasa

(10) Patent No.: US 10,134,371 B2
(45) Date of Patent: Nov. 20, 2018

(54) STROKE ADJUSTMENT DEVICE FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Hirotaka Higasa, Hamamatsu (JP)

(73) Assignee: KABUSHIKI KAISHA KAWAI GAKKI SEISAKUSHO, Hamamatsu-Shi, Shizuoka (JP)

( * ) Notice: Subject to any disclaimer, the term of this patent is extended or adjusted under 35 U.S.C. 154(b) by 0 days.

(21) Appl. No.: 15/706,459

(22) Filed: Sep. 15, 2017

(65) Prior Publication Data

US 2018/0096671 A1 Apr. 5, 2018

(30) Foreign Application Priority Data

Sep. 30, 2016 (JP) ..... 2016-192753

(51) Int. Cl.
*G10C 3/12* (2006.01)
*G10C 3/04* (2006.01)
*G10C 3/22* (2006.01)

(52) U.S. Cl.
CPC ..... *G10C 3/12* (2013.01); *G10C 3/04* (2013.01); *G10C 3/225* (2013.01)

(58) Field of Classification Search
CPC ..... G10C 3/12; G10C 3/04; G10C 3/225
See application file for complete search history.

(56) References Cited

U.S. PATENT DOCUMENTS 2,701,498 A * 2/1955 Feilhaber ..... G10C 3/12 84/377
5,406,875 A * 4/1995 Tamai ..... G10H 1/344 84/433
5,804,745 A * 9/1998 Higasa ..... G10C 3/26 84/182
7,145,062 B2 * 12/2006 Ishida ..... G10C 3/12 84/35
2011/0232454 A1 * 9/2011 Muramatsu ..... G10C 3/161 84/236
2017/0186412 A1 * 6/2017 V zquez D az ..... G10H 1/346
2018/0096671 A1 * 4/2018 Higasa ..... G10C 3/04

FOREIGN PATENT DOCUMENTS

JP 5070844 B2 11/2012

* cited by examiner

*Primary Examiner* — Robert W Horn
(74) *Attorney, Agent, or Firm* — Lewis Roca Rothgerber Christie LLP

(57) ABSTRACT

A stroke adjustment device for a keyboard instrument, which can finely adjust key depression stroke and hammer stroke to obtain sufficient controllability of weak tones during musical performance and make the dynamic range even wider. This device includes a lifting mechanism for lifting up and down a keyboard pillow on which rear ends of keys are placed, an operation mechanism manually operated for driving the lifting mechanism, and a driving force transmission mechanism for transmitting a driving force generated by operation of the operation mechanism to the lifting mechanism. The lifting mechanism has a rotating shaft body rotatably provided below the keyboard pillow, vertically movable rack parts in mesh with gear portions that rotate in unison with the rotating shaft, and a lifting part extending over the rack parts and vertically moving in unison with the rack parts to lift up and down the keyboard pillow.

3 Claims, 6 Drawing Sheets

STROKE ADJUSTMENT DEVICE FOR KEYBOARD INSTRUMENT

CROSS-REFERENCE TO RELATED APPLICATION(S)

This application claims priority of Japanese Patent Application Number 192753/2016, filed on Sep. 30, 2016, the entire content of which is incorporated herein by reference.

BACKGROUND OF THE INVENTION

Field of the Invention

The present invention relates to a stroke adjustment device for a keyboard instrument, and more particularly to a stroke adjustment device for a keyboard instrument, for adjusting a key depression stroke, which is a depth by which a key is depressed, and a hammer stroke, which is a distance between a hammer to be pivotally moved by key depression and a string to be struck by the hammer.

Description of the Related Art

Conventionally, as a stroke adjustment device of the above-mentioned type, there has been known one disclosed in Japanese Patent No. 5070844. This stroke adjustment device is applied to a keyboard-type percussion instrument having a keyboard, actions, and hammers similar to those of a general grand piano. In the keyboard-type percussion instrument, as in a grand piano, the keyboard is placed on a keyframe disposed on a keybed, in a state supported from below. The keyboard has a multiplicity of keys (white keys and black keys) each extending in a front-rear direction thereof and arranged side by side in a left-right direction thereof, and each of the keys is configured to be swingable about a balance pin erected in the vicinity of the center of the key in the front-rear direction of the keyboard. Further, each of the actions is placed on an associated one of the keys at a location rearward of the balance pin. Each of the hammers that can pivotally move upward is provided above the associated action, and above the hammer, there is provided a sounding body made of a metal and extending in the front-rear direction. In the keyboard-type percussion instrument constructed as above, when the front end of the key is depressed during musical performance, the rear portion of the key moves upward to cause the action to operate. Then, the hammer is pivotally moved upward by being pushed up by the action, and strikes the sounding body from below, whereby a musical tone is generated.

The stroke adjustment device applied to the above-described keyboard-type percussion instrument includes a pedal for stroke adjustment (hereinafter referred to as "the stroke pedal" in this section), which is provided in a lower part of the keyboard-type percussion instrument, a pedal connecting rod extending upward from a rear end of the stroke pedal and having an upper end thereof projecting upward through the keybed, an arm extending forward from the pedal connecting rod and having a front end thereof pivotally supported by the keybed, a lifting bar provided above the arm in a manner capable of retractably protruding upward from a keyframe and extending in the left-right direction, and a back felt which is disposed on the keyframe in a state covering the lifting bar from above and on which the rear ends of all the keys of the keyboard are placed.

When the stroke pedal is depressed by a player, the pedal connecting rod slides upward, and the arm is pivotally moved upward. In accordance with this, the lifting bar protrudes upward from the keyframe, and the rear ends of all the keys are pushed up via the back felt. Further, the actions placed on the rear ends of the respective keys are also pushed up, whereby the hammers are also pushed up into a state slightly pivotally moved upward. Through these operations, the front ends of all the keys are lowered by an amount corresponding to an amount by which the rear ends of all the keys are pushed up, whereby the key depression stroke of each key becomes shorter. At the same time, by being pushed up, the hammers become closer to the respective associated sounding bodies, and therefore the hammer stroke of each hammer also becomes shorter. As a consequence, the momentum of each hammer pivotally moved upward by key depression is reduced, which makes weaker the sound generated by the hammer striking the associated sounding body, thereby making it possible to generate weak tones during musical performance.

In the above-described conventional stroke adjustment device, by depressing the stroke pedal and shifting the depressed stroke pedal leftward, it is possible to hold the stroke pedal in the depressed state to thereby maintain the key depression stroke and the hammer stroke in the reduced state. However, in the above-described stroke adjustment device, each of the key depression stroke and the hammer stroke can only be set to two stroke types determined by whether or not the stroke pedal is depressed. For this reason, the conventional stroke adjustment device is not capable of finely adjusting either the key depression stroke or the hammer stroke, and hence it cannot be said that controllability of weak tones during musical performance is sufficient.

Further, in the case of applying the above-described stroke adjustment device to a grand piano generally provided with three pedals (a soft pedal, a sostenuto pedal, and a loud pedal), it is required to additionally provide new pedals of the above-described type. In this case, it is required to largely change the design of the existing grand piano, and add a large number of component parts to the same, which causes an increase in manufacturing costs.

SUMMARY OF THE INVENTION

It is an object of the present invention to provide a stroke adjustment device for a keyboard instrument, which is capable of finely adjusting a key depression stroke and a hammer stroke to thereby obtain sufficient controllability of weak tones during musical performance, and enables generation of smaller musical tones to thereby make the dynamic range even wider.

To attain the above object, in a first aspect of the present invention, there is provided a stroke adjustment device for a keyboard instrument including a keyboard having a plurality of keys arranged side by side in a left-right direction thereof, each extending in a front-rear direction thereof and configured to be swingable about a pivot provided in the vicinity of a center of the key in a longitudinal direction thereof, a plurality of actions each placed on an upper surface of an associated one of the keys at a location rearward of the pivot and configured to move in accordance with key depression of the associated key, and a plurality of hammers provided in association with the respective actions and each configured to pivotally move in accordance with motion of an associated one of the actions to thereby strike a stretched string, the stroke adjustment device being configured to adjust a keyboard pillow which extends along the left-right direction of the keyboard and on which rear ends of the keys in a key-released state are placed, to a predetermined level to thereby adjust a key depression stroke of the keys and a hammer stroke of the hammers, the stroke adjustment device comprising a keyboard pillow-lifting mechanism configured to lift up and down the keyboard pillow between a predetermined reference level and a pushed-up level higher than the predetermined reference level by a predetermined height, an operation mechanism configured to be manually operated so as to drive the keyboard pillow-lifting mechanism, and a driving force transmission mechanism configured to transmit a driving force generated by operation of the operation mechanism to the keyboard pillow-lifting mechanism, wherein the keyboard pillow-lifting mechanism comprises a rotating shaft not only extending below the keyboard pillow along the whole length of the keyboard pillow, but also rotatably provided, the rotating shaft being connected to the driving force transmission mechanism, a plurality of gear portions provided on the rotating shaft at respective predetermined locations in a longitudinal direction of the rotating shaft and configured to rotate in unison with the rotating shaft, a plurality of rack parts that are in mesh with the respective gear portions and are vertically movable, and a lifting part not only extending over the rack parts, but also being in contact with a lower surface of the keyboard pillow, the lifting part being configured to vertically move in unison with the rack parts in accordance with rotation of the rotating shaft through a predetermined angle to thereby lift up and down the keyboard pillow.

With this construction of the stroke adjustment device for a keyboard instrument, when adjusting the key depression stroke and the hammer stroke in the keyboard instrument, by manually operating the operation mechanism, a driving force generated by the operation is transmitted to the keyboard pillow-lifting mechanism via the driving force transmission mechanism. The keyboard pillow-lifting mechanism includes the rotating shaft disposed below the keyboard pillow on which the rear ends of the respective keys in a key-released state are placed, the gear portions that rotate in unison with the rotating shaft, the rack parts which are in mesh with the respective gear portions and are vertically movable, and the lifting part extending over the rack parts and being in contact with the lower surface of the keyboard pillow, the lifting part being configured to vertically move in unison with the rack parts in accordance with rotation of the rotating shaft through a predetermined angle. Therefore, a driving force generated by the operation of the operation mechanism is transmitted to the rotating shaft via the driving force transmission mechanism to cause the rotating shaft to rotate through a predetermined angle, whereby the keyboard pillow is pushed up by the lifting part from the reference level positioned before being pushed up, to the pushed-up level.

When the keyboard pillow is thus pushed up, the rear ends of the keys in the key-released state are pushed up, whereby each of the keys slightly swings about the pivot in a direction inclined forwardly downward. As a consequence, the front end of each key is lowered by an amount corresponding to an amount by which the rear end of the same is pushed up, and therefore the key depression stroke which is a depth of key depression becomes shorter than before the keyboard pillow is pushed up. Further, in this case, the action placed on the key at a location rearward of the pivot is also pushed up, whereby the hammer is pivotally moved to become closer to the string. As a consequence, the hammer stroke of the hammer, which is a distance between the hammer and the string, becomes shorter than before the keyboard pillow is pushed up, by an amount corresponding to a distance by which the hammer approaches the string.

As described above, according to the stroke adjustment device of the present invention, by manually operating the operation mechanism, the rotating shaft of the keyboard pillow-lifting mechanism is caused to rotate through a predetermined angle, via the driving force transmission mechanism, whereby it is possible to lift the keyboard pillow up and down between the reference level and the pushed-up level by the lifting part which vertically moves, to thereby finely adjust the key depression stroke and the hammer stroke. This makes it possible to obtain sufficient controllability of weak tones during musical performance and generate smaller musical tones, whereby the dynamic range can be made even wider.

Preferably, the operation mechanism comprises a rotary operation part provided on a lower surface side of a keybed of the keyboard instrument in a manner rotatable about a vertically extending axis, a gear portion formed on an outer peripheral surface of the rotary operation part, and a rack slider provided on the lower surface side of the keybed in a horizontally slidable manner and being in mesh with the gear portion of the rotary operation part, and the driving force transmission mechanism comprises an outer having a tube shape and disposed in a manner extending between the operation mechanism and the keyboard pillow-lifting mechanism, and an inner having a wire shape and slidably accommodated in the outer, with one end connected to the rack slider and another end connected to a hook provided on the rotating shaft in a radially protruding manner.

With this construction of the stroke adjustment device, when the rotary operation part on the lower surface side of the keybed is rotated, the rack slider in mesh with the gear portion on the outer peripheral surface of the rotary operation part thereby slides horizontally. Further, when the rack slider slides, the rotating shaft is thereby driven for rotation via the inner accommodated in the outer and connecting between the rack slider and the hook of the rotating shaft, and the keyboard pillow is lifted up and down via the lifting part that moves vertically in accordance with rotation of the rotating shaft. As described above, the operation mechanism and the driving force transmission mechanism for rotating the rotating shaft of the keyboard pillow-lifting mechanism can be realized by the relatively simple construction with ease and at low cost.

More preferably, the stroke adjustment device further comprises a lock mechanism for locking the rotating shaft at a plurality of rotation angles so as to set the keyboard pillow at a plurality of levels, and the lock mechanism comprises a lock bar extending over a predetermined length in a radial direction of the rotary operation part and having a base end thereof secured to the rotary operation part, a ball latch provided at a tip end of the lock bar and having a ball that can project and retract, and a lock member having a plurality of engagement recesses arranged along a passage trajectory of the tip end of the lock bar in a manner spaced from each other, and each formed such that the ball can be engaged therewith and disengaged therefrom, the lock member being configured to immovably lock the rotating shaft by engagement of the ball with any one of the engagement recesses according to a rotating operation of the rotary operation part.

With this construction of the stroke adjustment device, it is possible to lock the rotating shaft at a plurality of rotation angles by the lock mechanism to thereby set the keyboard pillow to a plurality of levels. In this lock mechanism, the rotary operation part is provided with the lock bar which extends in the radial direction of the rotary operation part and has the base end secured to the rotary operation part, and the ball latch is provided at the tip end of the lock bar. When the ball of the ball latch is engaged with any one of the engagement recesses of the lock member, the lock bar and the rotary operation part are thereby immovably locked. As a consequence, the inner of the driving force transmission mechanism is held immovable, and the rotating shaft is also held immovable, whereby the rotating shaft is held at a rotation angle selected at the time. As described above, the keyboard pillow can be easily set to a plurality of levels by the lock mechanism, which makes it possible to ensure fine adjustment of the key depression stroke and the hammer stroke.

The above and other objects, features, and advantages of the present invention will become more apparent from the following detailed description taken in conjunction with the accompanying drawings.

BRIEF DESCRIPTION OF THE DRAWINGS

FIGS. 9A and 9B are views useful in explaining push-up of the keyboard pillow, by a rotating operation of the drive shaft and a rising operation of the keyboard pillow push-up member caused by the rotating operation of the drive shaft, in which FIG. 9A shows a state before the keyboard pillow is pushed up, and FIG. 9B shows a state after the keyboard pillow is pushed up;

DETAILED DESCRIPTION OF PREFERRED EMBODIMENTS

Figure 1:
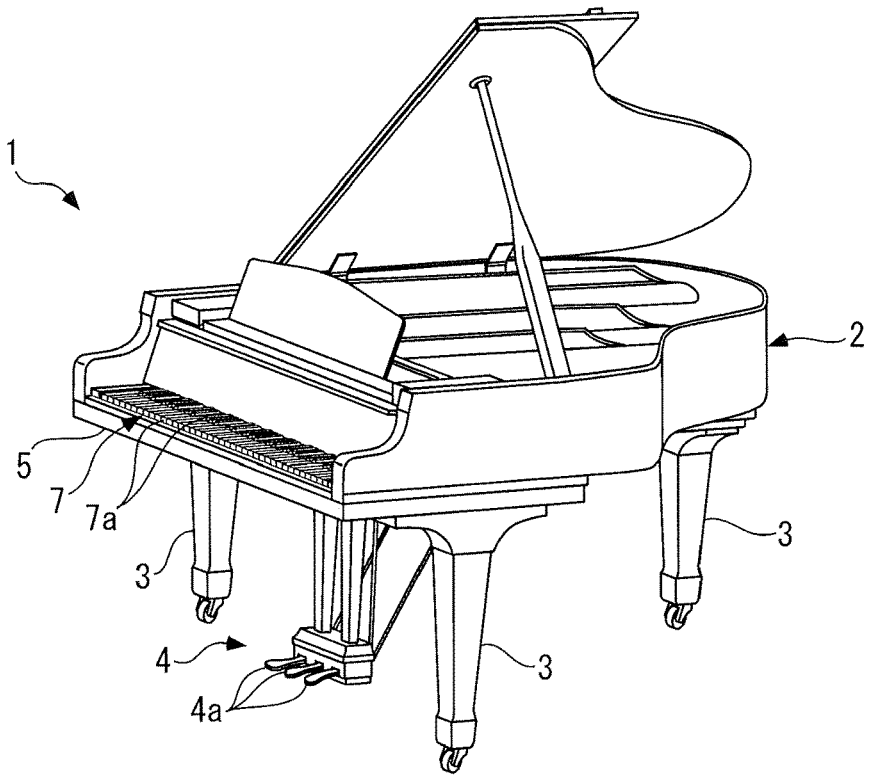
FIG. 1 is a perspective view of the appearance of a grand piano to which is applied a stroke adjustment device according to an embodiment of the present invention.

The present invention will now be described in detail with reference to the drawings showing a preferred embodiment thereof. FIG. 1 shows a grand piano to which is applied a stroke adjustment device for a keyboard instrument, according to an embodiment of the present invention. As shown in FIG. 1, the grand piano 1 (keyboard instrument) is comprised of a piano body 2, three legs 3 that support the piano body 2 from below, a pedal assembly 4 provided below the piano body 2 and having three pedals 4*a*, and so forth.

The piano body 2 includes a keybed 5 in the form of a flat plate, forming a front half of a bottom of the piano body 2, and on the keybed 5, there is placed a keyframe 6, referred to hereinafter, which supports a keyboard 7 from below. The keyboard 7 has a multiplicity of (e.g. 88) keys (white keys and black keys) 7*a* each extending in a front-rear direction thereof, and the keys 7*a* are arranged side by side in a left-right direction of the keyboard 7.

Figure 2:
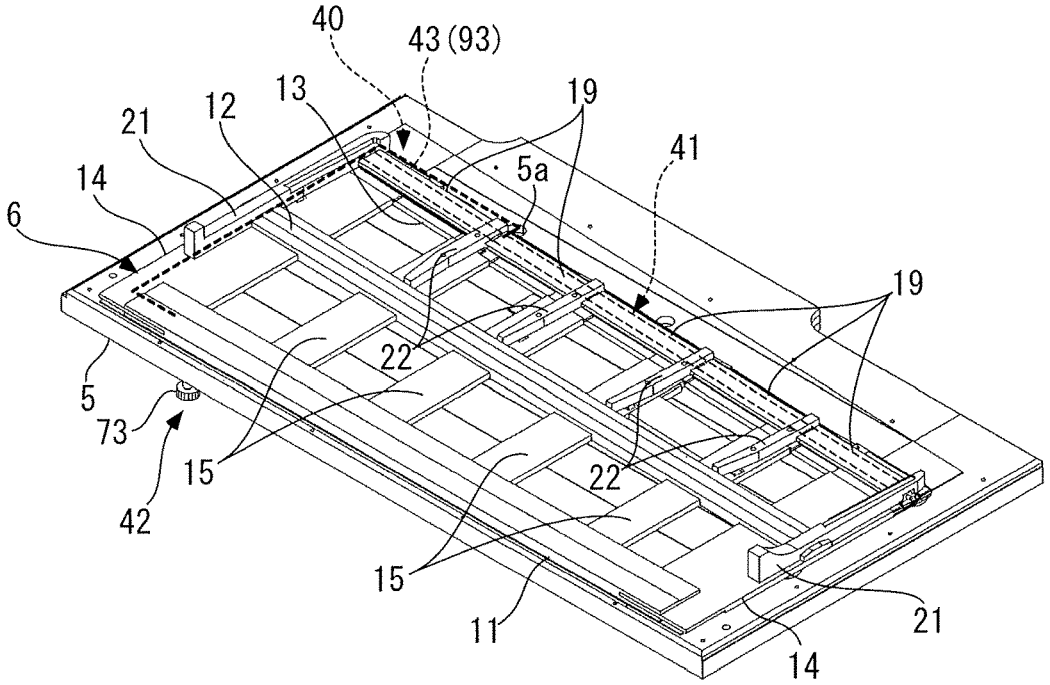
FIG. 2 is a perspective view of a keybed, a keyframe, and a keyboard pillow of the grand piano shown in FIG. 1.
Figure 3A:
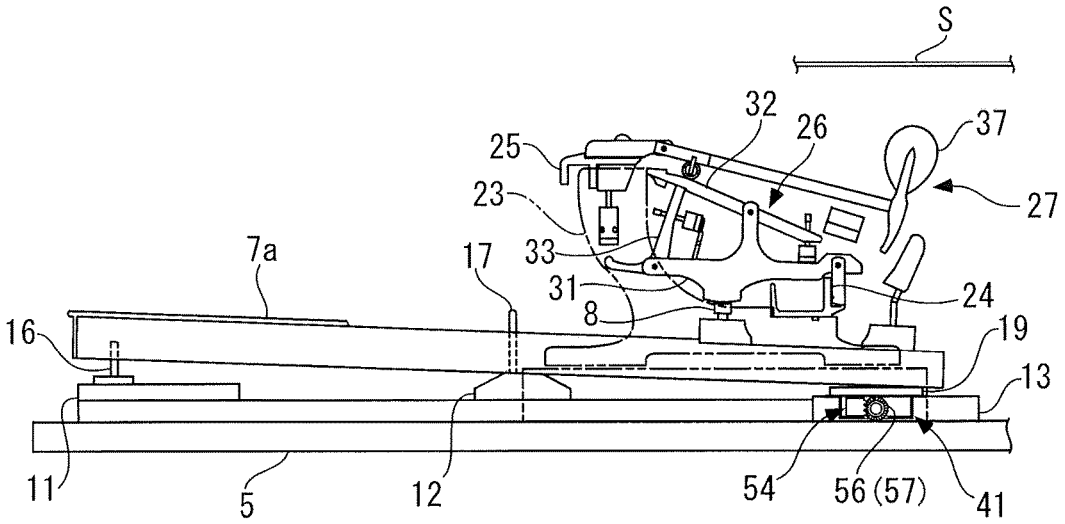
FIG. 3A is a side view of a key, an action, a hammer, and a keyboard pillow-lifting mechanism of the stroke adjustment device, in their entirety.
Figure 3B:
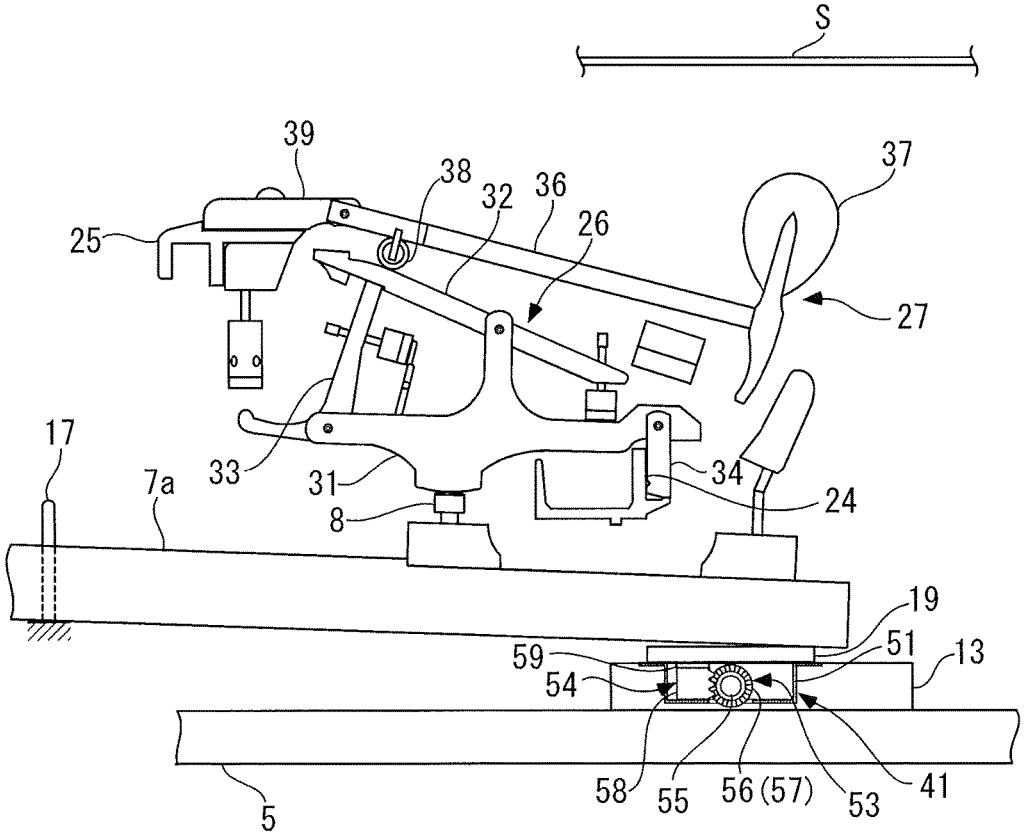
FIG. 3B is an enlarged side view of the keyboard pillow-lifting mechanism and associated components around the keyboard pillow-lifting mechanism.

As shown in FIG. 2, the keyframe 6 is formed by assembling wood workpieces of e.g. spruce in parallel crosses, and includes a keyframe front 11, a keyframe center 12, and a keyframe rear 13 each extending in the left-right direction, left and right keyframe plates 14 and 14 extending in the front-rear direction to connect these, and a plurality of (four in FIG. 2) keyframe inner bunches 15. On each of the keyframe front 11 and the keyframe center 12, there are erected a multiplicity of front pins 16 and balance pins 17 (see e.g. FIGS. 3A and 3B), and each of the keys 7*a* is supported in a manner swingable about an associated balance pin 17 (pivot) with its lateral swing being prevented by an associated front pin 16.

On the keyframe rear 13, there are arranged a plurality of (five in the present embodiment) keyboard pillows 19 along the longitudinal direction of the keyframe rear 13. Each of the keyboard pillows 19 is comprised of felt and has a laterally elongated rectangular shape in plan view, and the rear ends of respective keys 7*a* each downwardly inclined toward the rear of the keyboard 7 in a key-released state in which the front end of the key 7*a* has not been depressed are all placed on the keyboard pillows 19. Further, in the keyframe rear 13, there is embedded a keyboard pillow-lifting mechanism 41, referred to hereinafter, of the stroke adjustment device immediately below the keyboard pillows 19.

In left and right ends of the keyframe 6, there are placed action bracket bases 21 and 21 each extending in the front-rear direction on the respective keyframe plates 14 and 14, and on the keyframe inner bunches 15 and the keyframe rear 13 between the action bracket bases 21 and 21, there are disposed a plurality of (four in the present embodiment) intermediate bracket bases 22. Further, a plurality of (six in the present embodiment) brackets 23 (see FIGS. 3A and 4A) having a predetermined shape are installed on the keyframe 6 via the action bracket bases 21 and the intermediate bracket bases 22, and a wippen rail 24 and a hammer shank rail 25 (see FIGS. 3A, 3B, 4A, and 4B) extending in the left-right direction are bridged over the brackets 23. A plurality of actions 26 and a plurality of hammers 27 are pivotally supported by the wippen rail 24 and the hammer shank rail 25, respectively, in association with the respective keys 7*a*.

Now, a brief description will be given of the action 26 and the hammer 27 with reference to FIGS. 3A, 3B, 4A, and 4B. As shown in FIGS. 3A, 3B, 4A, and 4B, the action 26 is comprised of a wippen 31, a repetition lever 32, and a jack 33. The wippen 31 is pivotally supported by a wippen flange 34 fastened to the wippen rail 24 with screws, and is placed on a capstan screw 8 erected at a predetermined location on a rear portion of the associated key 7*a*. The repetition lever 32 and the jack 33 are pivotally supported by respective upper and front ends of the wippen 31, and an upper end of the jack 33 is engaged with the repetition lever 32 in a state extending through the front portion of the same.

On the other hand, the hammer 27 is comprised of a hammer shank 36 extending over a predetermined length in the front-rear direction, a hammer head 37 provided on a tip end of the hammer shank 36, and a shank roller 38 provided at a predetermined location close to a base end of the hammer shank 36 in a manner protruding downward. The hammer 27 is pivotally supported by a hammer shank flange 39 fastened to the hammer shank rail 25 with screws at the base end of the hammer shank 36, and the shank roller 38 is placed on the repetition lever 32.

In the action 26 and the hammer 27 constructed as above, as a rear part of an associated key 7*a* is moved upward by depression of the front end of the key 7*a*, the wippen 31 of the action 26 is pivotally moved upward, and in accordance with this, each of the repetition lever 32 and the jack 33 performs a predetermined operation. As a consequence, the hammer 27 is pivotally moved upward and strikes a string S, which is horizontally stretched, from below by the hammer head 37, whereby a musical tone is generated.

Next, a description will be given of the stroke adjustment device 40 of the present invention. The stroke adjustment device 40 is comprised of the keyboard pillow-lifting mechanism 41, an operation mechanism 42 that is manually operated to drive the keyboard pillow-lifting mechanism 41, and a driving force transmission mechanism 43 that connects between the mechanisms 41 and 42 and transmits a driving force generated by operation of the operation mechanism 42 to the keyboard pillow-lifting mechanism 41.

Figure 5:
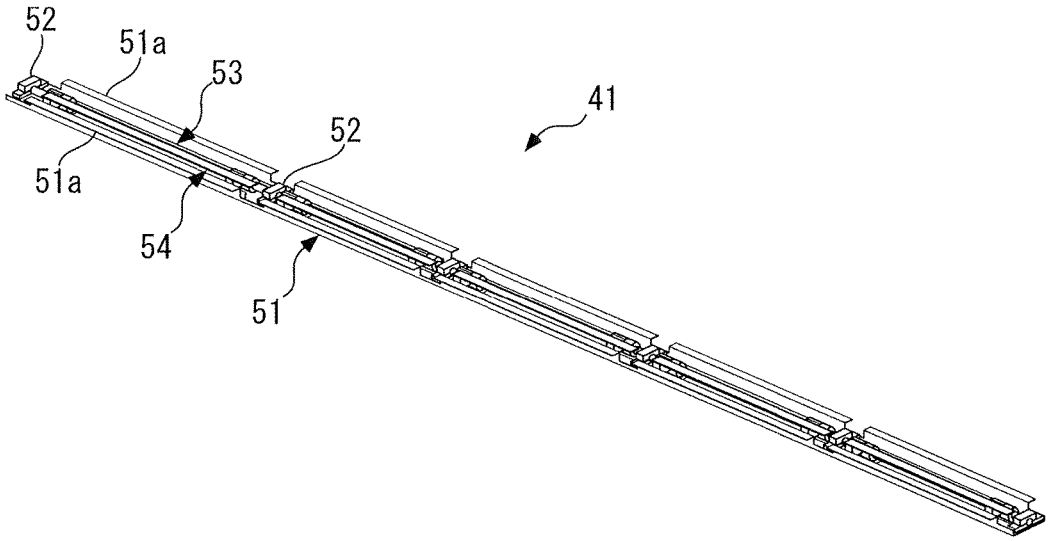
FIG. 5 is a perspective view of the keyboard pillow-lifting mechanism.
Figure 6:
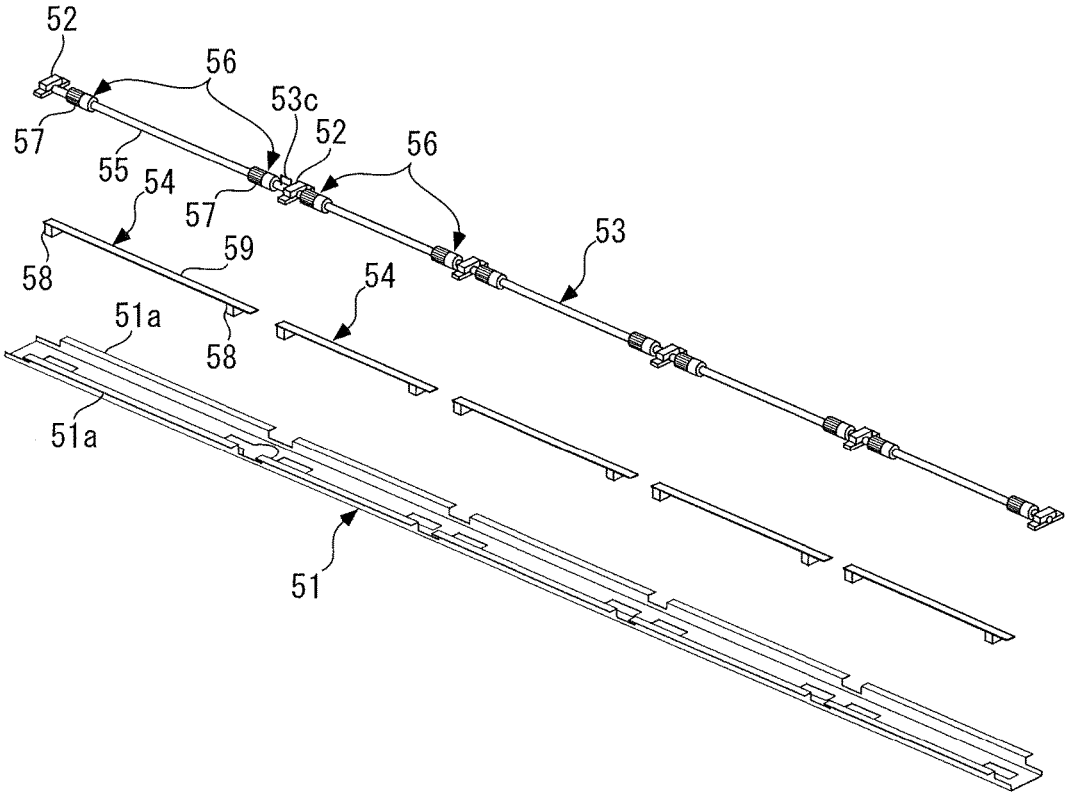
FIG. 6 is an exploded perspective view of the keyboard pillow-lifting mechanism shown in FIG. 5.

As shown in FIGS. 5 and 6, the keyboard pillow-lifting mechanism 41 is comprised of a base 51 extending over the whole length of the keyframe rear 13 and formed in a predetermined shape, a drive shaft 53 extending over a predetermined length in a longitudinal direction of the base 51 and rotatably mounted on the base 51 via a plurality of bearings 52, and a plurality of (five in the present embodiment) keyboard pillow push-up members 54 that are vertically movably guided by the base 51 to push up the respective keyboard pillows 19 in accordance with rotation of the drive shaft 53 through a predetermined angle.

The base 51 is formed in an upwardly open U shape by bending a metal plate having a predetermined shape, and is mounted in the keyframe rear 13 in an embedded state. Front and rear upper ends 51*a* and 51*a* of the base 51 are both formed to extend horizontally, by being bent outward at right angles, and the keyboard pillow 19 is placed on the base 51 in a manner bridging between the upper ends 51*a* and 51*a* (see FIG. 8). Note that the keyboard pillow 19 has its front end (left end as viewed in FIG. 8) bonded to the front upper end 51*a* of the base 51.

The drive shaft 53 is comprised of a rotating shaft body 55 (rotating shaft) having approximately the same length as the base 51, and a plurality of (ten in the present embodiment) drive rollers 56 that are fixed to the rotating shaft body 55 at respective predetermined locations in the longitudinal direction of the rotating shaft body 55 and are rotated in unison with the rotating shaft body 55. The drive rollers 56 form a plurality of (five in the present embodiment) pairs each constituted by two drive rollers 56 spaced from each other by a predetermined distance, and the drive rollers 56 and 56 of each pair are arranged in the longitudinal direction of the rotating shaft body 55. Each of the drive rollers 56 is formed in a hollow cylindrical shape, and the rotating shaft body 55 is inserted through the drive rollers 56. Further, the drive roller 56 has a gear portion 57 formed on an outer peripheral surface thereof.

On the drive shaft 53, at a predetermined location of the rotating shaft body 55, or specifically, between a second drive roller 56 from the left and a bearing 52 to the right thereof, there is provided a U-shaped hook 53*a* protruding in a predetermined radial direction (upward in the present embodiment) of the rotating shaft body 55. One end of an inner 92 of a driving force transmission cable 93, referred to hereinafter, is connected to the hook 53*a*.

Figure 7:
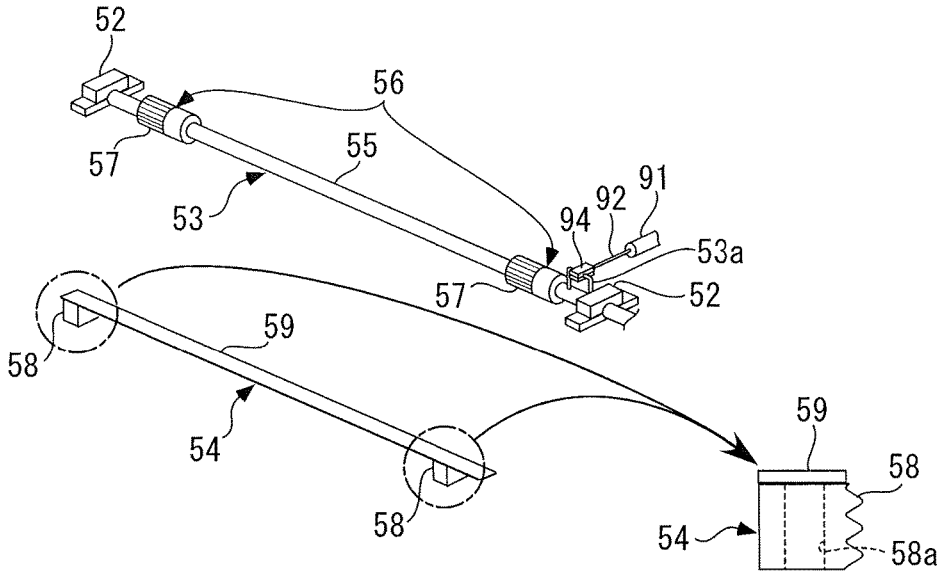
FIG. 7 is a view partially showing a drive shaft and a keyboard pillow push-up member of the keyboard pillow-lifting mechanism, on an enlarged scale, and showing a rack part of the keyboard pillow push-up member, on an enlarged scale.
Figure 8:
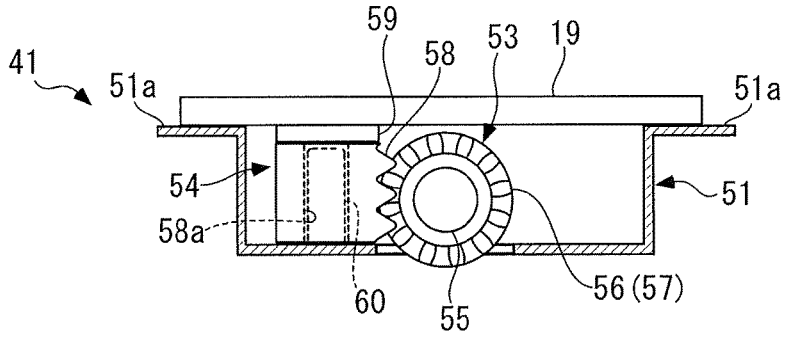
FIG. 8 is a right side view of the keyboard pillow and the keyboard pillow push-up member.

As shown in FIGS. 7 and 8, each of the keyboard pillow push-up members 54 is comprised of rack parts 58 which are formed in a block shape and are in mesh with the respective gear portions 57 of an associated pair of the drive rollers 56 and 56, and a lifting part 59 which is formed in the shape of a long slender plate extending between the two rack parts 58 and 58 and is in contact with the lower surface of the associated keyboard pillow 19. Each of the rack parts 58 is formed with a guide hole 58*a* open downward, and a guide pin 60 erected at a predetermined location on the base 51 for vertically guiding the keyboard pillow push-up member 54 is inserted in the guide hole 58*a* from below.

Figure 10A:
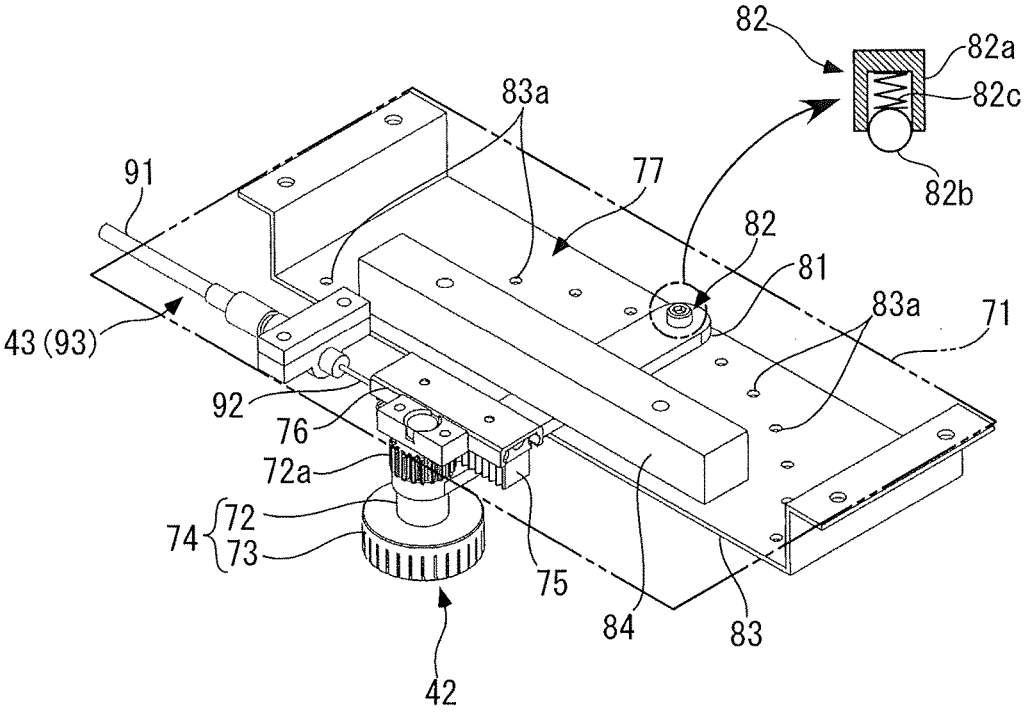
FIG. 10A is a perspective view of the operation mechanism.
Figure 10B:
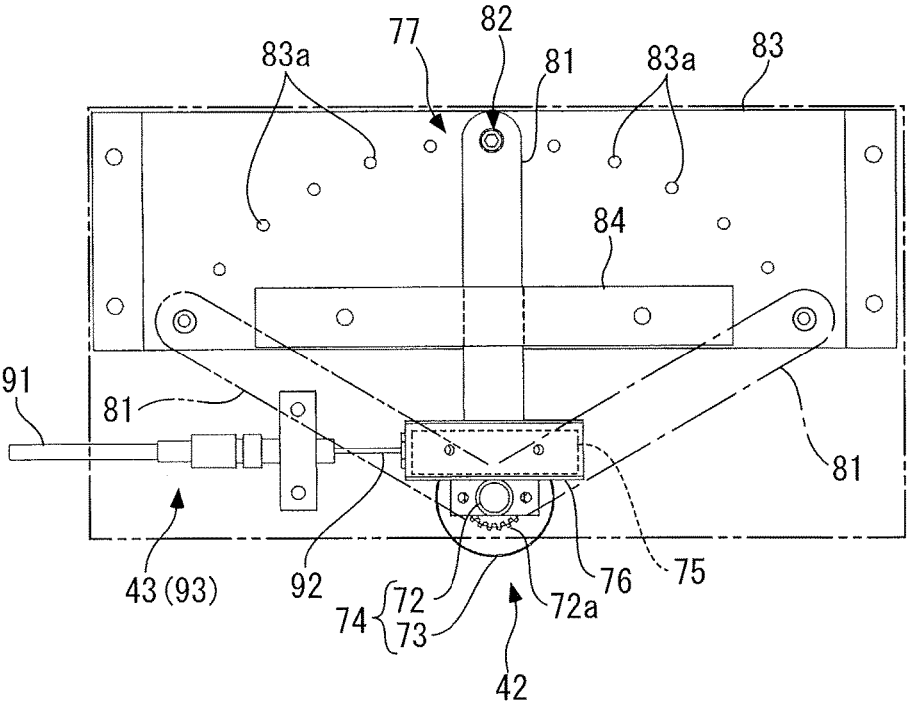
FIG. 10B is a plan view of the operation mechanism.

FIGS. 10A and 10B show the operation mechanism 42 of the stroke adjustment device 40. The operation mechanism 42 is screwed to a left front portion of the bottom of the keybed 5, and is configured to be manually rotatable. Specifically, the operation mechanism 42 is comprised of a mounting plate 71 having a laterally elongated rectangular shape in plan view and fastened to the bottom of the keybed 5 with screws, a rotary operation part 74 including a shaft 72 which extends vertically, and a rotary knob 73 which has an increased-diameter and is integrally provided at a lower end of the shaft 72, with an upper end of the shaft 72 being rotatably supported by the mounting plate 71, and a rack slider 75 which is in mesh with a gear portion 72*a* formed on an outer peripheral surface of the shaft 72 and is configured to be horizontally slidable in the left-right direction. The rack slider 75 is slidably engaged with a guide rail 76 extending in the left-right direction and fastened to the mounting plate 71 with screws, and one end of the inner 92 of the driving force transmission cable 93, referred to hereinafter, of the driving force transmission mechanism 43 is connected to a left end of the rack slider 75.

Further, the stroke adjustment device 40 is provided with a lock mechanism 77 for locking the drive shaft 53 at a plurality of rotation angles so as to set the keyboard pillow 19 to a plurality of levels, respectively. The lock mechanism 77 includes a lock bar 81 that radially extends over a predetermined length from the shaft 72 of the rotary operation part 74 and rotates in unison with the rotary operation part 74, a ball latch 82 attached to a tip end of the lock bar 81, and a lock plate 83 (lock member) mounted to the mounting plate 71 in a manner extending around below the lock bar 81. The lock plate 83 has a plurality of (thirteen in the present embodiment) lock holes 83*a* (engagement recesses) formed in a manner spaced from each other and arranged in an arc shape along a passage trajectory of the ball latch 82 provided at the tip end of the lock bar 81 pivotally moved in unison with the rotary operation part 74.

As shown in FIG. 10A, the ball latch 82 is comprised of a holder 82*a* having a downwardly open hollow cylindrical shape and attached to the tip end of the lock bar 81, a ball 82*b* having a predetermined diameter and provided in the holder 82*a* in a retractable manner, and a spring 82*c* provided in the holder 82*a* so as to urge the ball 82*b* downward. When a lower portion of the ball 82*b* of the ball latch 82 is engaged with one of the lock holes 83*a*, in a state fitted therein from above, the lock bar 81 is thereby immovably locked, whereby the rotary operation part 74 and the rack slider 75 are immovably locked, and as a consequence, the drive shaft 53 is locked at a predetermined rotation angle.

Note that, from the state described above, when a certain magnitude of force is applied to the rotary operation part 74 in a rotational direction, the ball 82*b* of the ball latch 82 is pushed up by the edge of the lock hole 83*a* in engagement with the same against the urging force of the spring 82*c*. This disengages the ball 82*b* from the lock hole 83*a*, thereby making it possible to rotate the rotary operation part 74.

Further, above the lock bar 81, there is provided a block 84 rigidly secured to the mounting plate 71 at a predetermined location in a manner extending in the left-right direction for slidable contact with the upper surface of the lock bar 81. This block 84 prevents the lock bar 81 from being warped upward during pivotal motion thereof, whereby the ball 82*b* of the ball latch 82 is brought into secure engagement with a lock hole 83*a* of the lock plate 83, to thereby ensure stable locking of the lock bar 81.

The driving force transmission mechanism 43 is formed by the driving force transmission cable 93 comprised of an outer 91 having a tube shape and a predetermined length, and the inner 92 having a wire shape and slidably accommodated in the outer 91. The driving force transmission cable 93 is routed on the lower surface of the keybed 5 in a manner extending from the operation mechanism 42 at a front side of the piano body 2 around a left side of the same to the keyboard pillow-lifting mechanism 41 at a rear side of the same, as shown in FIG. 2.

Further, as shown in FIGS. 10A and 10B, at one end of the driving force transmission cable 93, one end of the outer 91 is secured to the mounting plate 71 of the operation mechanism 42, and one end of the inner 92 is secured to a left end of the rack slider 75. On the other hand, at the other end of the driving force transmission cable 93, the other end of the outer 91 is secured onto the keybed 5 via a through hole 5*a* (see FIG. 2) formed at a predetermined location in the keybed 5, and the other end of the inner 92 is connected to the aforementioned hook 53*a* of the drive shaft 53 of the keyboard pillow-lifting mechanism 41 via a connector 94.

In the stroke adjustment device 40 constructed as above, when the rotary knob 73 of the rotary operation part 74 appearing in FIGS. 10A and 10B is rotated clockwise, the rack slider 75 slides rightward, whereby the inner 92 of the driving force transmission cable 93 is pulled toward the operation mechanism 42. This causes the drive shaft 53 to rotate through a predetermined angle in the clockwise direction, as viewed in FIG. 8, and the keyboard pillow push-up member 54 having the rack parts 58 in mesh with the gear portions 57 of the respective drive rollers 56 is moved upward.

On the other hand, when the rotary knob 73 of the rotary operation part 74 appearing in FIGS. 10A and 10B is rotated counterclockwise, the rack slider 75 slides leftward, whereby tension by the inner 92 is released. This causes the drive shaft 53 to rotate through a predetermined angle in the counterclockwise direction, as viewed in FIG. 8, by an urging force of a spring, not shown, or the weight of the keyboard pillow push-up member 54 and the like, and in accordance with this, the keyboard pillow push-up member 54 having shifted to an upper position is moved downward.

Figure 9A:
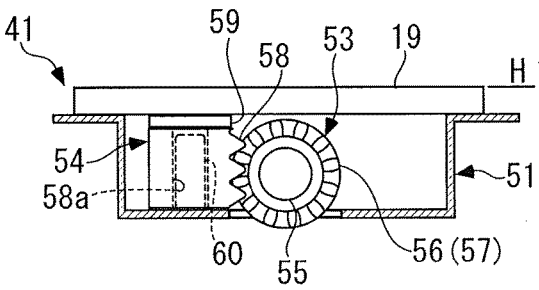
Figure 9B:
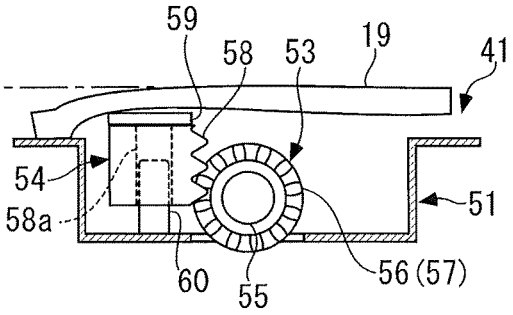

FIGS. 9A and 9B show operations for lifting up and down the keyboard pillow 19 by rotation of the drive shaft 53 and the vertical motion of the keyboard pillow push-up member 54. FIG. 9A shows a state in which the keyboard pillow 19 is positioned at a reference level which is a lowest level, and FIG. 9B shows a state in which the keyboard pillow 19 is positioned at a pushed-up level which is a highest level. When the keyboard pillow push-up member 54 is at the level shown in FIG. 9A, the lock bar 81 of the operation mechanism 42 is in a position pivotally moved leftward as indicated by two-dot chain lines in FIG. 10B. On the other hand, when the keyboard pillow push-up member 54 is at the level shown in FIG. 9B, the lock bar 81 is in a position pivotally moved rightward as indicated by one-dot chain lines in FIG. 10B. Therefore, by rotating the rotary knob 73 in the clockwise direction, the keyboard pillow push-up member 54 is moved upward, whereby the keyboard pillow 19 is pushed up by a predetermined height H (e.g. 1.5 mm) at the maximum.

Figure 4A:
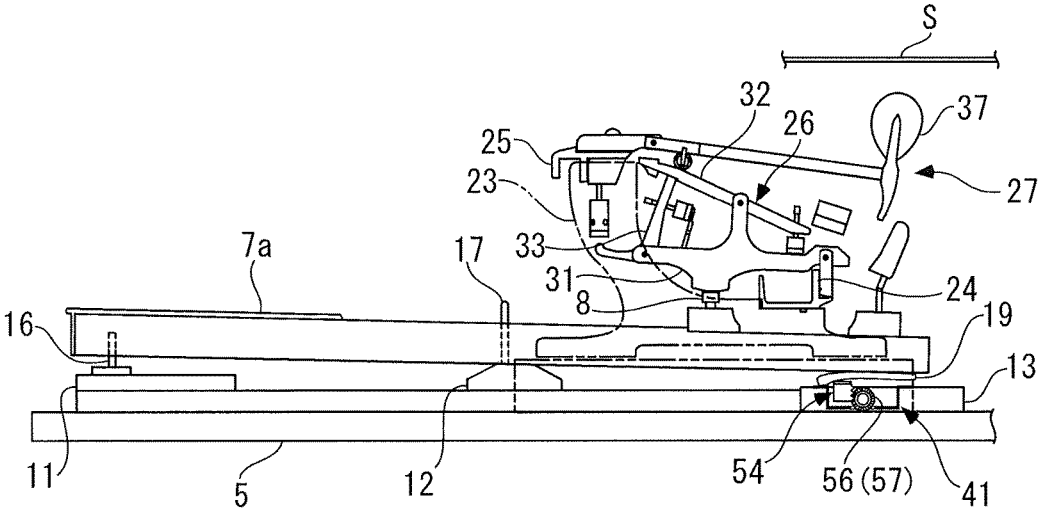
FIGS. 4A and 4B are views, corresponding to FIG. 3A and FIG. 3B, respectively, which show a state in which the keyboard pillow has been pushed up.
Figure 4B:
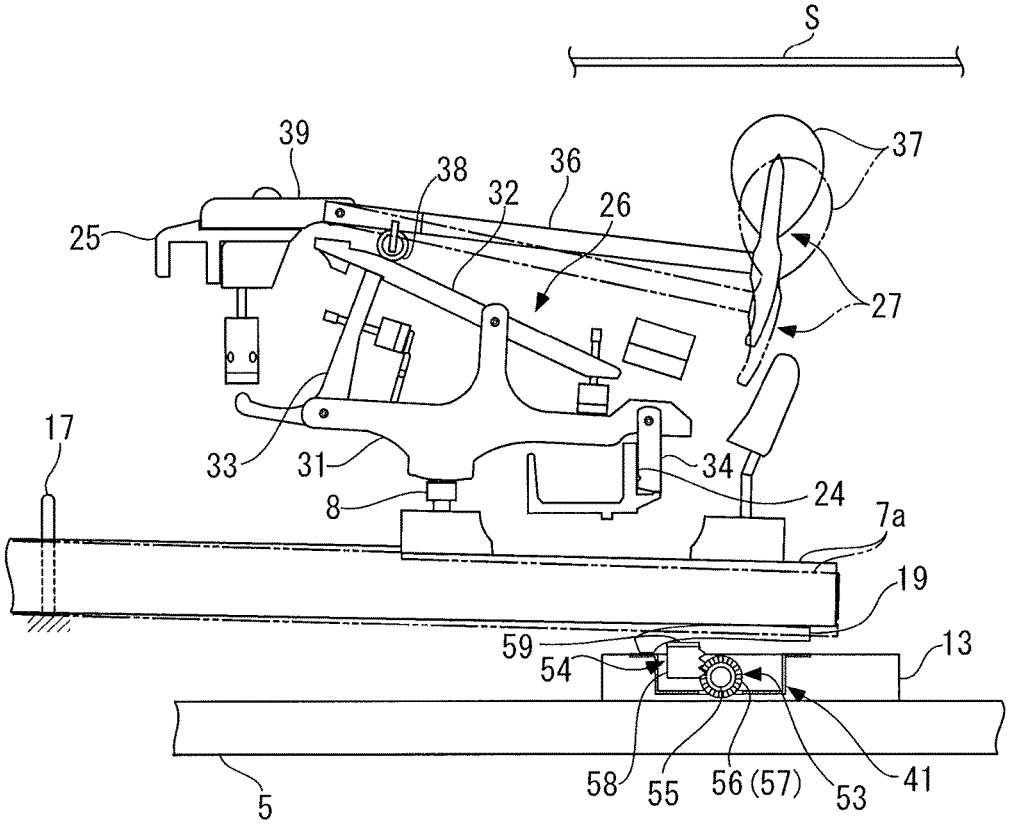

When the keyboard pillow 19 is pushed up as described above, the rear ends of all the keys 7*a* of the keyboard 7 are pushed up as shown in FIGS. 4A and 4B, whereby each of the keys 7*a* slightly swings about the associated balance pin 17 in a direction inclined forwardly downward (direction inclined leftwardly downward, as viewed in FIGS. 4A and 4B). As a consequence, the front end of the key 7*a* is lowered by an amount approximately equal to an amount by which the rear end of the same is pushed up, and a key depression stroke, which is a depth of key depression of the key 7*a*, becomes shorter than before the keyboard pillow 19 is pushed up.

In this case, when the rear end of the key 7*a* is pushed up, the action 26 placed on the capstan screw 8 at the rear portion of the key 7*a* is also pushed up. Then, the hammer 27 placed on the repetition lever 32 of the action 26 via the shank roller 38 is slightly pivotally moved in the counterclockwise direction as indicated by solid lines in FIG. 4B, whereby the hammer head 37 is moved closer to the string S above the same. As a consequence, as for the hammer 27, a hammer stroke, which is a distance between the hammer head 37 and the string S, becomes shorter by an amount corresponding to the reduction of the distance than before the keyboard pillow 19 is pushed up.

As described above, according to the present embodiment, by rotating the rotary knob 73 manually, it is possible to rotate the drive shaft 53 through a predetermined angle via the driving force transmission cable 93 to thereby cause the keyboard pillow push-up member 54, which is vertically movable, to lift up and down the keyboard pillow 19 between the reference level and the pushed-up level for fine adjustment of the key depression stroke and the hammer stroke. This makes it possible to obtain sufficient controllability of weak tones during musical performance. Further, since weaker tones can be generated, it is possible to make the dynamic range even wider.

Note that the present invention is not limited to the above-described embodiment, but can be practiced in various forms. For example, although in the embodiment, the stroke adjustment device 40 of the present invention is applied to a grand piano, this is not limitative, but the present invention can also be applied to an upright piano. Further, although in the embodiment, the operation mechanism 42 of the stroke adjustment device 40 is described as a type operated by rotating the rotary knob 73, this is not limitative, but it is possible to employ mechanisms of different operation types, including a type operated by moving a lever in the front-rear direction or in the left-right direction. Furthermore, although in the embodiment, as the driving force transmission mechanism 43, the driving force transmission cable 93 is adopted which has the outer 91 and the inner 92, this is not limitative, but the driving force of the operation mechanism 42 may be transmitted to the keyboard pillow-lifting mechanism 41 by a linkage.

The detailed construction of the stroke adjustment device 40 in the above-described embodiment is given only by way of example, and it can be modified, as desired, insofar as it does not depart from the subject matter of the present invention.

What is claimed is:

1. A stroke adjustment device for a keyboard instrument including a keyboard having a plurality of keys arranged side by side in a left-right direction thereof, each extending in a front-rear direction thereof and configured to be swingable about a pivot provided in the vicinity of a center of the key in a longitudinal direction thereof, a plurality of actions each placed on an upper surface of an associated one of the keys at a location rearward of the pivot and configured to move in accordance with key depression of the associated key, and a plurality of hammers provided in association with the respective actions and each configured to pivotally move in accordance with motion of an associated one of the actions to thereby strike a stretched string, the stroke adjustment device being configured to adjust a keyboard pillow which extends along the left-right direction of the keyboard and on which rear ends of the keys in a key-released state are placed, to a predetermined level to thereby adjust a key depression stroke of the keys and a hammer stroke of the hammers, the stroke adjustment device comprising:

a keyboard pillow-lifting mechanism configured to lift up and down the keyboard pillow between a predetermined reference level and a pushed-up level higher than the predetermined reference level by a predetermined height;

an operation mechanism configured to be manually operated so as to drive the keyboard pillow-lifting mechanism; and a driving force transmission mechanism configured to transmit a driving force generated by operation of the operation mechanism to the keyboard pillow-lifting mechanism, wherein the keyboard pillow-lifting mechanism comprises:

a rotatable shaft extending below the keyboard pillow along the entire length of the keyboard pillow, the rotable shaft being connected to the driving force transmission mechanism;

a plurality of gear portions provided on the rotatable shaft at respective predetermined locations in a longitudinal direction of the rotable shaft and configured to rotate in unison with the rotable shaft;

a plurality of rack parts that are in mesh with the respective gear portions and are vertically movable; and a lifting part extending over the rack parts, and in contact with a lower surface of the keyboard pillow, the lifting part being configured to vertically move in unison with the rack parts in accordance with rotation of the rotatable shaft through a predetermined angle to lift up and down the keyboard pillow.

2. The stroke adjustment device according to claim 1, wherein the operation mechanism comprises:

a rotary operation part provided on a lower surface side of a keybed of the keyboard instrument in a manner rotatable about a vertically extending axis, a gear portion formed on an outer peripheral surface of the rotary operation part, and a rack slider provided on the lower surface side of the keybed in a horizontally slidable manner and being in mesh with the gear portion of the rotary operation part, and wherein the driving force transmission mechanism comprises:

an outer portion having a tube shape and disposed in a manner extending between the operation mechanism and the keyboard pillow-lifting mechanism, and an inner portion having a wire shape and slidably accommodated in the outer portion, with one end connected to the rack slider and another end connected to a hook provided on the rotating shaft in a radially protruding manner.

3. The stroke adjustment device according to claim 2, further comprising a lock mechanism for locking the rotating shaft at a plurality of rotation angles so as to set the keyboard pillow at a plurality of levels, wherein the lock mechanism comprises:

a lock bar extending over a predetermined length in a radial direction of the rotary operation part and having a base end thereof secured to the rotary operation part, a ball latch provided at a tip end of the lock bar and having a ball that can project and retract, and a lock member having a plurality of engagement recesses arranged along a passage trajectory of the tip end of the lock bar in a manner spaced from each other, and each formed such that the ball can be engaged therewith and disengaged therefrom, the lock member being configured to immovably lock the rotating shaft by engagement of the ball with any one of the engagement recesses according to a rotating operation of the rotary operation part.

* * * * *